United States Patent [19]

Himmelmann et al.

[11] 4,287,299

[45] Sep. 1, 1981

[54] PROCESS FOR THE PRODUCTION OF MATTING LAYERS

[75] Inventors: Wolfgang Himmelmann; Rolf Brück; Wolfgang Sauerteig, all of Leverkusen; Peter Kruck, Cologne; Günter Kolb; Günter Sackmann, both of Leverkusen, all of Fed. Rep. of Germany

[73] Assignee: Agfa-Gevaert AG, Leverkusen, Fed. Rep. of Germany

[21] Appl. No.: 149,496

[22] Filed: May 13, 1980

[30] Foreign Application Priority Data

May 16, 1979 [DE] Fed. Rep. of Germany ..... 2919822

[51] Int. Cl.[3] ..... G03C 1/76

[52] U.S. Cl. ..... 430/537; 430/523; 430/950

[58] Field of Search ..... 430/950, 537, 523

[56] References Cited

U.S. PATENT DOCUMENTS

| | | | |
|---|---|---|---|
| 3,615,531 | 10/1971 | Meyer et al. | 430/537 |
| 3,811,913 | 5/1974 | Kasugai et al. | 530/537 |
| 4,126,460 | 11/1978 | Okishi | 430/950 |
| 4,153,458 | 5/1979 | Iguchi et al. | 430/523 |

FOREIGN PATENT DOCUMENTS

| | | | |
|---|---|---|---|
| 1055713 | 1/1967 | United Kingdom | 430/537 |

*Primary Examiner*—J. Travis Brown

*Attorney, Agent, or Firm*—Connolly and Hutz

[57] ABSTRACT

For the production of matted outer layers of photographic silver halide recording materials particles of a copolymer of maleic acid anhydride and a $C_2$–$C_8$ monoolefin are dispersed in an aqueous solution of a hydrophilic colloid and the dispersion thus formed is applied to one or both surfaces of the photographic recording material and the layer is dried.

5 Claims, No Drawings

PROCESS FOR THE PRODUCTION OF MATTING LAYERS

This invention relates to a process for the production of matt-finished outer layers of photographic recording materials which counteract the tendency of these materials toward sticking.

The surface layer of standard photographic silver halide recording materials contains a hydrophilic colloid, for example gelatin, as binder. Accordingly, the tackiness of recording materials such as these increases in the presence of high atmospheric moisture, above all at relatively high temperatures, with the result that the recording materials easily stick together, for example after stacking. This tendency towards sticking between various parts of the recording material or between the recording material and other materials which come into contact with it gives rise to considerable difficulties in the camera and during the production, processing, projection or storage of the recording material.

It is known that, in order to overcome these difficulties the surface layer of the recording material may be provided with a matt finish through the incorporation of finely powered inorganic compounds, such as silicon dioxide, magnesium oxide, titanium dioxide or calcium carbonate, or organic compounds, such as polymethyl methacrylate or cellulose acetate propionate, thereby reducing its tackiness. However, this "matt finishing" has various disadvantages. For example, the surface layer cannot be homogeneously produced because the finely powdered constituents referred to above readily aggregate in the coating solution. In addition, recording materials having a surface layer containing the finely powdered materials are more easily damaged and are more difficult to transport in a camera or a projector because their surface is far from smooth. In addition, the presence of the finely powdered materials in the surface layer reduces the transparency of the recording material after processing and increases the graininess of the image.

German Offenlegungsschrift No. 2,758,767 describes a light sensitive photographic material which comprises an outer light sensitive gelatin layer containing colloidal silica particles ranging from 7 to 120 mμ in diameter and a polymer latex of which the particles range from 30 to 80 mμ in diameter. This gelatin layer provides the photographic material with increased resistance to breakage and dimensional stability.

However, a photographic material finished in this way has the disadvantage that the additives reduce the transparency of the layers and sensitometrically unfavourable contact marks cannot be avoided when the materials are rolled up, particularly at relatively high humidity levels (more than 85%) and at temperatures of the order of 35° to 40° C.

There are various processes known for producing fine-grained materials with a matting effect. Thus, polymer particles having a particle diameter of from 5 to 0.01 micron may be produced by emulsion polymerisation provided that the quantity of emulsifier (surfactant), the polymerisation temperature and the stirring conditions are suitably controlled. This process is described for example by H. Reinhard, Dispersionen synthetischer Hochpolymerer, (Dispersions of Synthetic High Polymers), Part II, pages 3 et seq, Springer Verlag and by F. Holscher in the corresponding Part I, pages 31 et seq. However, it is not readily possible in this way to produce particles having a uniform size of more than 2 microns. It is possible by mechanical powdering, followed by grading according to particle size, to obtain polymer particles having a wide particle size distribution. However, the particles thus obtained are not spherical, but completely irregular in shape.

Spherical polymer particles may be produced by dissolving a polymer in a water-immiscible organic solvent and spraying the resulting solution under high pressure from a fine nozzle into an aqueous medium. However, the particle size obtained in this way is by no means uniform, in addition to which a large-volume apparatus is required. Hitherto, there has in general never been a useful, economic process for the production of polymer particles having a particle size within the range of from 1 to 10 microns.

Fine polymer particles may also be produced by dispersion. To this end, one or more polymers is or are dissolved in a solvent which is insoluble in or substantially immiscible with water and which has a lower boiling point than water or which forms with water azeotropic mixture having a lower boiling point than water. The polymer solution is dispersed in the form of droplets in an aqueous medium where it forms an oil phase, the viscosity and surface tension being suitable adjusted, after which the solvent is removed from the droplets of the oil phase to form fine polymer particles. These particles may be separated off in the form of a powder by subsequent centrifuging and drying (German Offenlegungsschrift No. 2,522,692).

However, this process has the disadvantage that the particles have to be produced during the stirring step, i.e. they are not pre-formed. The particle size depends on the concentration of the polymer solution, on the ratio between the polymer solution and the aqueous medium, on the type and quantity of hydrophilic colloid used and on the temperature, the stirring speed and the pH-value of the aqueous medium. In addition, the low-boiling solvent has to be distilled off carefully in order not to destroy the particles.

It is also possible to obtain small particles from a suspension polymerisation process. In general, polymers having a particle diameter of from 10 to 1000μ are obtained in the form of a suspension in water. However, it is not possible to obtain particles having the required diameter of from 1 to 10μ in homogeneous distribution.

It is an object of the present invention to provide a process for the production of surface layers which reduce the tackiness of a photographic material and of which the matt finishing is not attended by the disadvantages of known matting layers, particularly in regard to the impression of graininess of the photographic material.

The present invention relates to a process for the production of matt-finished outer layers of photographic silver halide recording materials which contain polymer particles dispersed in a binder as matting agent, characterised in that spherical particles of a substantially alternating and equimolecular grouped suspension copolymer of maleic acid anhydride and a $C_2$–$C_8$ monoolefin having a particle size of from 1 to 10μ, and preferably from 1.5 to 5μ, are dispersed in an aqueous solution of a hydrophilic colloid in a quantity of from 1 to 15% by weight, and preferably in a quantity of from 5 to 10% by weight, based on the weight of the dispersion, the dispersion thus formed is applied to one or both surfaces of the photographic recording material in such a quantity that the layer applied contains from 10 to 500 mg/m$^2$ of the particles, and the layer is dried.

Suspension copolymers suitable for the purposes of the invention are, for example, copolymers of maleic acid anhydride and monoolefins or aromatic vinyl compounds which may be obtained in the presence of macromolecular dispersants in the form of fine powders having a uniform particle size. Relevant details, particularly in regard to the production process, may be found in German Offenlegungsschrift No. 2,501,123. In addition, reference is made to G. Sackmann and G. Kolb, Angewandte Makromolekulare Chemie 1978, pages 141 to 156.

The following copolymers are mentioned as examples of particularly suitable particles:

Copolymer 1.

diisobutylene/maleic acid anhydride (1:1 mole)
most frequent particle size 2 to 3μ
distribution:
80% 2 to 3μ
10% 3 to 4μ
5% 1 to 2μ
5% 0.5 to 1μ

Copolymer 2.

diisobutylene/maleic acid anhydride (1:1 mole)
most frequent particle size: 1.5 to 2μ
distribution:
90% 1.4 to 1.6μ
10% 1.6 to 1.9μ

Copolymer 3.

diisobutylene/maleic acid anhydride (1:1 mole)
most frequent particle size: 3μ
distribution:
80% 3μ
20% 0.4 to 3μ

Copolymer 4.

diisobutylene/maleic acid anhydride (1:1 mole) most frequent particle size: 3μ
distribution:
70% 3μ
30% 0.4 to 1.5μ

The copolymers used according to the invention are substantially alternating and equimolecular suspension copolymers of maleic acid anhydride and $C_2$–$C_8$ monoolefins or aromatic vinyl compounds which are copolymerised in the presence of a radical former at temperatures of from 30° to 200° C. and under pressures of from 1 to 200 bars in an organic dispersion medium of monoolefin or of monoolefin and a solvent inert to the monomers which dissolves the monoolefin and the aromatic vinyl compound, but not the maleic acid anhydride, in the presence of from 0.5 to 50% by weight, based on the maleic acid anhydride used, of a dispersant which is soluble in the dispersion medium. The dispersants used are reaction products of alternating copolymers of maleic acid anhydride and $C_2$ to $C_8$ monoolefins, of maleic acid anhydride and vinyl esters, of maleic acid anhydride and vinyl ethers, of maleic acid anhydride and aromatic vinyl compounds with at least one primary, aliphatic, saturated or monoolefinically unsaturated, linear or branched monohydric alcohol containing from 6 to 22 carbon atoms or with at least one primary or secondary, aliphatic, saturated, linear or branched monoamine containing from 6 to 22 carbon atoms or mixtures thereof.

Monoolefins which may be used for producing the alternating copolymers with maleic acid anhydride include ethylene, propylene, butylene, isobutylene, 1-hexene, diisobutylene (2,4,4-trimethyl-1-pentene). Suitable aromatic vinyl compounds are styrene and α-methyl styrene.

However, it is also possible to use mixtures of the monoolefins with one another and also mixtures of monoolefins and aromatic vinyl compounds.

This copolymerisation process gives readily filterable copolymer powders which consist essentially of discrete spheres with particle diameters of from 1 to 10 μm and which have a very narrow particle size distribution. The size of the particles formed and their particle size distribution may be controlled both through the type and also through the quantity of dispersant used, more particularly through the quantity thereof. Thus, the average particle diameter of the copolymer particles decreases with increasing quantity of dispersant, accompanied by an increase in uniformity. For example, the average particle diameter of a suspension copolymer of maleic acid anhydride and diisobutylene produced with 3% by weight of dispersant, based on the sum of the monomers copolymerising in a molar ratio of 1:1 amounts to approximately 10 μm whereas, where 10% by weight and 20% by weight of dispersant are used, particles sizes of the order of 3 μm and 2 μm, respectively, are obtained. The uniformity of the particle size distribution increases with increasing quantity of dispersant. Thus, 3% by weight of dispersant produces relatively irregular particle sizes, 10% by weight produces largely uniform particle sizes with a few differences and 20% by weight produces completely uniform particle sizes. In addition, the uniformity of the particle sizes may be influenced by additional technical measures during production of the copolymers, such as for example the type of stirrer used or the stirring speed.

It is of course also possible by this process to obtain particle sizes and particle size distributions which lie outside the range of 1 to 10 μm required for use in photographic recording materials. The particles obtained are free from any residue and may be used without any further grinding and sieving operations.

The copolymers have an alternating and equimolecular structure with degrees of polymerisation of from 20 to 1000 and preferably from 50 to 300, corresponding to molecular weights of from about 4000 to 200,000 and preferably from 10,000 to 60,000, as determined by membrane osmometry. The preferred copolymers have intrinsic viscosities of from 0.05 to 0.70 dl/g, as measured in dimethyl formamide (DMF) at 25° C.

The experimental production of the copolymers according to the invention is described in the following, for example with reference to copolymer 3:

The following reaction mixture is introduced into a 2-liter three-necked flask equipped with a stirrer, thermometer, reflux condenser, dropping funnel and an inlet for the introduction of nitrogen:

306.25 g (3.13 M) of maleic acid anhydride 967.5 g (8.64 M) of diisobutylene (commercial mixture of approximately 75% by weight of 2,4,4-trimethyl-1-pentene and approximately 25% by weight of 2,4,4-trimethyl-2-pentene)

159.75 g of a 37% solution of a dispersant * in diisobutylene.

*Dispersant = maleic acid anhydride/diisobutylene copolymer of which approximately 50 mole percent of the anhydride groups have been converted into semiester groups by reaction with dodecyl alcohol.

The mixture is heated with stirring (220 r.p.m.) to 75° C. while a gentle stream of nitrogen is passed over. 25% by volume of the following initiator solution (I) are then added:

8.125 g (0.375 M) of t-butyl per-2-ethyl hexanoate 62.50 g of diisobutylene.

The temperature is then increased to 90° C. over a period of 1 hour and the remainder of (I) is added dropwise over a period of another hour.

After the initiator has been added, the mixture is stirred for 6 hours at 90° C. It is then cooled to room temperature, the finely divided copolymer suspension formed is removed under suction on the filter, washed with fresh diisobutylene and dried to constant weight at 70° C. in a vacuum drying cabinet. Yield: 654 g (≙99.5% of the theoretical).

Copolymers 1, 2 and 4 were produced similarly, but with different quantities of dispersant:

Copolymer 1: 155.33 g of dispersant

Copolymer 2: 310.65 g of dispersant

Copolymer 4: 150.88 g of dispersant

To determine the size of the particles, the copolymer powders are suspended in a 1:1 mixture of water and glycerol, counted out under an optical microscope with a phase contrast device (1000× magnification) and measured.

In a second operation, the powders are dispersed in aqueous solutions of hydrophilic colloids using wetting agents of any type. The following compounds for example may be used as the hydrophilic colloids: proteins, such as gelatin, gelatin derivatives, for example acetylated gelatin, phthaloyl gelatin or succinyl gelatin, albumin, casein, gum arabic, agar-agar, alginic acid, cellulose derivatives, for example alkyl sters of carboxy methyl cellulose, preferably the methyl or ethyl ester, hydroxy ethyl cellulose or carboxy methyl cellulose, synthetic polymers, for example polyvinyl alcohol, polyvinyl pyrrolidone, polyacrylamide, salts of polyacrylic acid, salts of polymethacrylic acid, salts of polymaleic acids, salts of polystyrene sulphonic acid, preferably the sodium or potassium salts, and copolymers containing at least one of the monomers of the abovementioned polymers. Of these hydrophilic colloids, amphoteric polymeric electrolytes, such as gelatin, gelatin derivatives, casein and other protein compounds, have a particularly pronounced effect. They may also be used individually or in the form of a combination. Preferred colloids include gelatin, gelatin derivatives, casein and other protein compounds. The colloid is best used in a quantity of from about 1 to about 15% by weight and preferably in a quantity of from 5 to 10% by weight, based on the weight of the dispersion.

From 0.1 to 1% by weight of a surfactant, based on the weight of the water, is generally used as a dispersion aid. Examples of suitable surfactants include saponin and other compounds of natural origin, non-ionic surfactants, such as alkylene oxide, glycerol compounds, such as monoglycerides, glycidol compounds, anionic surfactants containing one or more acid groups such as, for example, one or more carboxylic acid, sulphonic acid, phosphoric acid, sulphonic acid ester or phosphoric acid ester groups. Particularly suitable surfactants are described in U.S. Pat. Nos. 2,271,623; 2,240,472; 2,288,226; 2,676,122; 2,676,924; 2,676,975; 2,691,566; 2,721,860; 2,730,498; 2,742,379; 2,739,891; 3,068,101; 3,158,484; 3,201,253; 3,210,191; 3,294,540; 3,415,649; 3,441,413; 3,442,654; 3,475,174 and 3,545,974; German Offenlegungsschrift No. 1,942,665; British Pat. Nos. 1,077,317 and 1,198,450; "Kaimen Kassei Zai no Gosei to Sono Ohyo" (Synthesis and Application of Surface Active Agents) by Ryohei Oda et al (published by Maki Publishing Co., 1964); "Surface Active Agents" by J. W. Perry and A. M. Schwartz (published by Interscience Publications Inc., 1958); "Encyclopedia of Surface Active Agents", Vol 2, by J. P. Sisley (published by Chemical Publishing Co., 1964); and "Kaimen Kassei Zai Binran (Surfactants Encyclopedia)", 6th Edition, (published by Sangyo Tosho Co., 20th Dec. 1976). Fluorine-containing wetting agents, of the type described for example in German Offenlegungsschrift No. 1,961,638, may also be used.

These surfactants may also be used individually or in combination. Particularly suitable compounds are those containing an $SO_3M$-group, such as for example sulphonate esters of standard alcohols corresponding to the general formula $R—O—SO_3M$ or $R—(OCH_2CH_2)_n-CSO_3M$, in which R is an alkyl group containing from 8 to 30 carbon atoms, M is an alkali metal or ammonium ion and n is a positive integer of up to 20, and alkyl benzene sulphonic acid compounds corresponding to the following general formula:

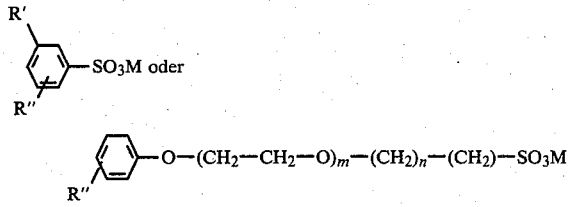

in which R' is hydrogen or an alkyl group containing from 1 to 18 carbon atoms, R'' is an alkyl group containing from 1 to 18 carbon atoms, M is an alkali metal or ammonium ion, m is a positive integer of from 0 to 20 and n is the number 3 or 4.

From 70 to 80% of the resulting dispersions of copolymers having particle sizes of from 1 to 10μ and preferably from 1.5 to 5μ accumulate in the same size, i.e. in the form of particles having the same diameter. Only 20 to 30% of the particles have a larger or smaller diameter.

The dispersions may either be added directly to the photographic casting solutions for the uppermost protective layer or, alternatively, the particles may be isolated by centrifuging in the form of a paste or solid residue. It is possible in this way to obtain so-called "instant matting agents", i.e. matting agents which may be stirred into any photographic casting solution without any need to use dispersion aids. The compounds are photographically inert and do not affect the graininess of the recording material provided that they are used in the recommended quantity of from about 500 to 100 mg per square meter of surface.

The advantageous matting effect obtained by the process according to the invention may be further improved by adding colloidal silica in the form of a hydrosol to the matting dispersion before it is applied to the surface of the photographic material. Good results are obtained with commercial hydrosols having a particle size of from 1 to 150 nm which are added to the matting dispersion in quantities of from 0.5 to 2 parts by weight, based on 1 part by weight of the hydrophilic colloid.

The silica particles introduced with the hydrosol differ from the copolymer particles of the invention by orders of magnitude and, therefore, take no part in their specific effect. The contribution of the silica particles to the overall effect is merely that they further suppress the, in any case limited, tendency of the surface layers produced by the process according to the invention to develop smooth spots or colour marks.

The casting compositions used in accordance with the invention for producing the surface layers may, if desired, contain further additives which have no influence upon the matting effect according to the invention. Examples of additives such as these are very fine grained (diameter less than 0.1μ) latices of hard polymers, such as polystyrene, polymethyl methacrylate; also very fine-grained (particle diameter less than 0.1μ) latices of soft homopolymers and copolymers, such as polyethyl acrylate, polyacrylic acid butyl ester ethyl acrylate or latices of polyethers or polyester polyurethanes, of the type described in the journal "Research Disclosure", December, 1978, Industrial Opportunities Ltd., Hampshire, U.K., page 27 (XII A); conductivity-increasing compounds of the type described in "Research Disclosure", December, 1978, page 27 (XIII A) and, finally, hardeners of the type described in "Research Disclosure", December, 1978, page 26 under (X.) and casting aids of the type described in "Research Disclosure", December 1978, page 26 under (XI).

The compounds according to the invention may be used with advantage in the protective or surface layers of photographic black-and-white and colour materials and in the so-called non-curling layers of rolls and miniature films or flat films.

The invention is illustrated by the following Examples.

EXAMPLE 1

1900 ml of water were introduced into a three-liter glass beaker. 100 g of gelatin (alkaline-ashed) were then added with stirring. The gelatin is then swollen for 30 minutes and subsequently melted with stirring at 40° C. A suspension of 20 g of matting agent in a solution of 0.2 g of the following wetting agent $$C_8F_{17}SO_3^{\ominus}[N(C_2H_5)_4]^{\oplus}$$

in 120 ml of ethanol was then added and the mixture treated in a high-pressure homogeniser. The dispersion was filtered under light pressure through a gauze filter. The dispersion may then be either directly added to the protective layer casting solution or may be converted by centrifuging into a paste containing from 50 to 60% of water. The dispersion contained approximately 5% by weight of gelatin and 1% by weight of copolymer.

The dispersions were added to samples of a casting solution for a protective layer for a colour negative film. The casting solutions had the following compositions:

Casting solution:

400 g of aqueous gelatin solution (15%)
2800 g of water (deionised)
80 g of wetting agent corresponding to the formula $$C_8F_{17}SO_3^{\ominus}[N(C_2H_5)_4]^{\oplus}$$

in the form of a 4% solution in water
4 g of polymeric matting agent as specified below 2000 g of a 10% by weight aqueous solution of a hardener corresponding to the following formula:

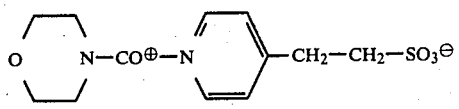

wet coating: 50 g/m²; pH 6.5–7.0.

The following casting solutions were prepared in accordance with the above recipe:

A comparison sample without matting agent
B casting solution containing copolymer 1
C casting solution containing copolymer 2
D casting solution containing copolymer 3
E casting solution containing copolymer 4

In addition, casting solutions containing the following known matting agents were prepared as comparison samples:

| | |
|---|---|
| F polymethyl methacrylate particles (corresponding to U.S. Pat. No. 2,322,037) | diameter 3 to 8 μ |
| G polytetrafluoroethylene particles | diameter 2 to 6 μ |
| H calcium carbonate (corresponding to British Patent No. 1,173,181) | diameter 1 to 5 μ |
| I acetyl cellulose (corresponding to U.S.Pat. No. 2,268,662) | diameter 3 to 8 μ |
| K reaction product of starch, urea and formaldehyde (corresponding to German Patent No. 1,146,749, Example 1) | diameter 3 to 8 μ |
| L zinc carbonate (corresponding to German Offenlegungsschrift No. 1,547,869) | diameter 2 to 7 μ |
| M gelatin, hardened (corresponding to U.S. Pat. No. 2,043,906) | diameter 5 to 15 μ |

Using a casting machine, the casting solutions were applied as the uppermost protective layer (wet coating 50 g of solution per square meter) to an unhardened colour negative film and the layer thus applied was dried at 25° C./60% relative humidity. The protective layers formed a dry layer of 0.6 to 0.7 g/m².

The colour negative film used had a conventional structure. A red-sensitised silver halide layer containing an emulsified cyan dye component, an intermediate layer, a green-sensitised silver halide layer containing a magenta component, a yellow filter layer and a blue-sensitised silver halide layer containing a yellow component were applied successively to a cellulose triacetate support.

The intermediate layers consisted of gelatin and a casting aid. In addition, the yellow filter layer contained yellow colloidal silver. The layers containing silver halide had thicknesses of from 5 to 6μ, whilst the intermediate layer was between 1 and 2μ thick. The film was cast without hardening agents and was hardened by overcoating with the uppermost protective layer solution.

| Constituent | Red-sensitive | Green-sensitive Emulsion layer | Blue-sensitive |
|---|---|---|---|
| dye | 4-chloro-N-n- | 1,2,4,6-trichloro- | 3-(2,4-diamyl |

-continued

| Constituent | Red-sensitive | Green-sensitive Emulsion layer | Blue-sensitive |
|---|---|---|---|
| former | dodecyl-l-hydroxy naphthamide (0.88 g/m²) | phenyl-3-[3-(2,4-di-t-amyl phenoxy)-acetamido]-benzamido-5-pyrazolone (0.75 g/m²) | phenoxyacetamido) o-(4-methoxy benzoyl)-acetanilide (1.31 g/m²) |
| coating aid | sodium salt of dodecyl benzene sulphonic acid (42 mg/m²) sodium salt of nonyl phenoxy polyethylene hydroxypropane sulphonic acid (53 mg/m²) | sodium salt of dodecyl benzene sulphonic acid (51 mg/m²) sodium salt of nonyl phenoxy polyethylene hydroxypropane sulphonic acid (64 mg/m²) | sodium salt of dodecyl benzene sulphonic acid (67 mg/m²) sodium salt of nonyl phenoxy polyethylene hydroxypropane sulphonic acid (84 mg/m²) |
| layer thickness | 5 μ | 6 μ | 5 μ |

After drying, samples A and M were tested as follows:

Test 1: Smooth spots

The samples were cut into pieces measuring 5 cm² and conditioned for 2 days at 30° C./90% humidity. The samples were then stored for 1 day under pressure, in each case with the layer side against the back. The samples were then torn apart from one another and the size of the bonded surface was estimated (smooth spots on the surface).

Test 2: Cartridge withdrawal

A 35 mm wide and 125 cm long film was wound into a film cartridge and stored for 7 days at 35° C./90% relative humidity. The force (p) required to withdraw the film from the cartridge was then determined and recorded. The maximum value is shown for each sample in the following Table. In practice, the withdrawal force should be no higher than 300 p.

Test 3: Yellow spot test

The film stored under the conditions of test 2 was photographically developed and inspected for visible faults attributable to the effects of storage, pressure and moisture. The number and size of the coloured spots of different sizes was evaluated as a percentage of the surface area inspected. A film having a suitable protective layer should contain less than 5% of yellow spots.

Test 4: Graininess

The graininess of a photographic image was caused by the developed colour grain and by dispersions and matting agents, above all in the uppermost layers. It was determined by determining the σ-D-value with a 29μ diaphragm, as described by J. H. Altmann in Appl. Optics, Volume 3, (1964), pages 35 to 38. A graininess of 1.8 is a desirable value in photography.

| Sample | Test 1 (smooth spots) in % | Test 2 (cartridge withdrawal) in p | Test 3 (color spots) in % | Test 4 (graininess) σ-D-value |
|---|---|---|---|---|
| A | 80–90 | 1000–1500 | 20–50 | 1.8 |
| B | 5–10 | 150–250 | 0–3 | 1.8 |
| C | 5–10 | 150–250 | 0–3 | 1.7 |
| D | 5–10 | 150–250 | 0–3 | 1.8 |
| E | 5–10 | 150–250 | 0–3 | 1.9 |

-continued

| Sample | Test 1 (smooth spots) in % | Test 2 (cartridge withdrawal) in p | Test 3 (color spots) in % | Test 4 (graininess) σ-D-value |
|---|---|---|---|---|
| F | 5–10 | 150–250 | 0–3 | 2.2 |
| G | 5–10 | 150–250 | 0–3 | 2.0 |
| H | 20–30 | 600–800 | 10–20 | 1.8 |
| I | 5–10 | 150–250 | 0–3 | 2.3 |
| K | 5–10 | 300–400 | 10–20 | 2.4 |
| L | 10–20 | 250–400 | 10–20 | 2.1 |
| M | 20–30 | 700–1000 | 20–30 | 2.6 |

The results set out in the preceding Table show the overall advantageous properties of the matting particles according to the invention. Although in some tests some of the comparison samples attain results which are comparable with those of the matting samples according to the invention, it is only the samples according to the invention which provide uniformly favourable results throughout all of the tests, including—remarkably—the graininess test.

The proportion of relatively large particles in dispersions having a wide particle size distribution range is particularly noticeable in the case of test 4. All of the comparison dispersions show greater graininess in this test which gives rise to considerable problems in practice.

EXAMPLE 2

Quantities of 1900 cc of water were initially introduced into three-liter glass beakers, followed by the dissolution therein of 100 g of (a) acid-ashed gelatin (isoelectric point: (9)
(b) acetyl gelatin (obtained by reaction with 10% by weight of acetanhydride)
(c) polyvinyl pyrrolidone (molecular weight 50,000)
(d) cellullose sulphate
(e) polyacrylamide (molecular weight 40,000)

A suspension of 20 g of copolymer 1 in a solution of 0.2 g of the wetting agent $$C_8F_{17}SO_3^{\ominus}[N(C_2H_5)_4]^{\oplus}$$

in 120 ml of ethanol is added to each of the samples. The mixtures were then treated in the same way as described in Example 1. The samples were then filtered through a gauze filter and centrifuged, giving a paste which contained from 50 to 60% by weight, based on the copolymer particles.

As described in Example 1, the pastes were added to individual protective layer casting solutions which were then applied to the layer side of a colour negative film.

The composition of the protective layer casting solutions was as follows:

400 g of a 15% by weight aqueous gelatin solution
2600 g of water (deionised)
70 g of a 4% by weight solution of the wetting agent $C_7F_{15}COO^{\ominus}(NH_4)^{\oplus}$
4 g of polymeric matting agent (copolymer 3)
1000 g of a 10% by weight aqueous solution of a reaction product of taurine with the compound $C(CH_2—SO_2—CH=CH_2)_4$ (1:1 molar) as cross-linking agent.

Protective layers in which the particles were aggregate-free were obtained in every case. The results were determined by microscopic comparison of the samples.

The samples were tested for their effectiveness as spacers (preventing smooth contact between the protective layer and the back of a stacked or rolled material) by the four methods described in Example 1. The comparison sample F was a layer structure containing a protective layer without copolymer. The dry layer thicknesses amounted to between 0.6 and 0.7μ (coating of approximately 0.6 to 0.7 g/m²).

| Sample | Test 1 (smooth spots) in % | Test 2 (cartridge withdrawal) in p | Test 3 (color spots) in % | Test 4 (graininess) σ-D-value |
|---|---|---|---|---|
| (a) | 5–10 | 200–250 | 0–3 | 1.8 |
| (b) | 10 | " | " | 1.9 |
| (c) | 8–10 | " | " | 1.9 |
| (d) | 15 | " | " | 1.8 |
| (e) | 10 | " | " | 1.8 |
| (f) | 80–90 | 1000–1500 | 20–50 | 1.8 |

Sample (f) contains no copolymer 3. The withdrawal force (test 2) is therefore very high (strong adhesion). In practice, a value of 300 p should not be exceeded. Accordingly, the sample is unusable.

The results show that the copolymer particles according to the invention are extremely effective spacers, irrespective of the film formers used as the dispersion medium. The particles prevent contact between an emulsion side and the back of a wound photographic film material because the matting material according to the invention projects partly beyond the surface of the protective layer.

A comparison of the quantities of particles present in the protective layer per unit area of the photographic material before and after colour processing shows that the particles are not dissolved in the alkaline developer, i.e. they retain their spacing effect, even after processing of the material.

EXAMPLE 3

The effect of the copolymers according to the invention as spacers may be increased by the addition of colloidal silica in the form of $SiO_2$-hydrosols to the protective layer composition.

Protective layers having the following composition were prepared:

| | A | B |
|---|---|---|
| gelatin solution (15% in water) | 400 g | 200 g |
| water (deionised) | 2800 g | 2900 g |
| copolymer 3 | 4 g | 4 g |
| silica sol, 30% by weight in water, particle size 14 mμ | — | 100 g |
| wetting agent of Example 1 4% by weight in water | 80 g | 80 g |
| hardener (10% by weight in water) corresponding to the formula indicated below | 2000 g | 2000 g |

The solutions had a pH value of from 6.5 to 7. The wet coating amounted to 50 g/m².

The hardener corresponds to the following formula

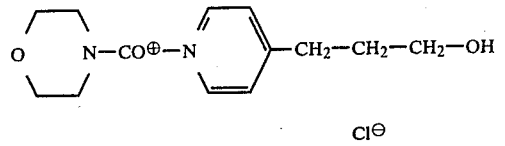

The protective layer solutions were cast onto an unhardened color negative film and dried.

The tests described in Example 1 were then carried out.

| Protective layer | Test 1 (smooth spots) in % | Test 2 (cartridge withdrawal) in p | Test 3 (color spots) in % | Test 4 (graininess) σ-D-value |
|---|---|---|---|---|
| A | 5–10 | 150–250 | 0–3 | 1.8 |
| B | 0–5 | 150–200 | 0 | 1.8 |

Smooth spots and colour spots can be almost completely avoided by combining the copolymers according to the invention with silica sol, as shown by sample B.

We claim:

1. In a process for producing photographic material having a supported layer containing particles of a narrow grain size distribution, stable in alkaline solutions to provide a matt surface, the steps of providing a dispersion for the layer comprising, providing a layer cast as a surface layer of the photographic material, including casting as the surface layer a composition consisting essentially of a hydrophilic colloid and 1–15% by weight of the dispersion polymer particles dispersed in the colloid, said polymer dispersion being obtained by forming a finally divided copolymer suspension of spherical particles of a substantially alternating and equimolecular grouped suspension copolymer of maleic acid anhydride and $C_2$–$C_8$ monoolefin having a particle size from 1 to 10μ dispersing said particles in a aqueous solution of a hydrophilic colloid in a quantity of from 1 to 15% by weight, based on the weight of the dispersion.

2. A process as claimed in claim 1, characterised in that from 0.1 to 1% by weight, based on the weight of the water contained in the dispersion, of a surface-active substance is added to the dispersion before casting.

3. A process as claimed in claim 1, characterised in that gelatin is used as the hydrophilic colloid.

4. A process as claimed in claim 1, characterised in that a copolymer of diisobutylene and maleic acid anhydride (1:1 mole) is used.

5. A process as claimed in claim 1, characterised in that colloidal silica in the form of a hydrosol having a particle size of from 1 to 15 nm is added to the dispersion before casting in a quantity of from 0.5 to 2 parts by weight of colloidal silica particles per part by weight of the hydrophilic colloid.

* * * * *